US005083671A

United States Patent [19]

Hayes

[11] Patent Number: 5,083,671

[45] Date of Patent: Jan. 28, 1992

[54] CLOSURE FOR A WIDE MOUTH CONTAINER

[75] Inventor: Thomas H. Hayes, Lancaster, Ohio

[73] Assignee: Anchor Hocking Packaging Company, Lancaster, Ohio

[21] Appl. No.: 515,728

[22] Filed: Apr. 27, 1990

Related U.S. Application Data

[63] Continuation-in-part of Ser. No. 450,039, Dec. 13, 1989, Pat. No. 5,040,961.

[51] Int. Cl.[5] ..... B65D 41/32

[52] U.S. Cl. ..... 215/245; 215/235; 215/253; 215/224; 220/339; 220/306; 220/269

[58] Field of Search ..... 215/235, 201, 237, 245, 215/224, 253, 216; 220/334, 335, 339, 90.4, 254, 375, 306, 269; 16/225, 227, DIG. 13

[56] References Cited

U.S. PATENT DOCUMENTS

| | | | |
|---|---|---|---|
| 995,720 | 6/1911 | Reiss | 215/235 |
| 1,430,308 | 9/1922 | Hill | 215/235 |
| 2,140,077 | 12/1938 | Fuchs | 215/235 |
| 2,894,654 | 7/1959 | Löhrer | 215/235 |
| 3,977,559 | 8/1976 | Lombardi | 220/90.4 |
| 4,043,475 | 8/1977 | Wheeler | 215/224 |
| 4,146,146 | 3/1979 | Mar | 220/375 X |
| 4,414,705 | 11/1983 | Ostrowsky | 215/237 |
| 4,467,931 | 8/1984 | Gach | 215/237 |
| 4,487,324 | 12/1984 | Ostrowsky . | |
| 4,669,622 | 6/1987 | Bennett . | |
| 4,693,399 | 9/1987 | Hickman et al. | 215/237 |
| 4,700,858 | 10/1987 | Bennett . | |
| 4,714,181 | 12/1987 | Kozlowski et al. | 215/224 |
| 4,718,567 | 1/1988 | LaVange | 215/224 |
| 4,807,768 | 2/1989 | Gach | 215/237 |
| 4,807,769 | 2/1989 | Gach | 215/235 |
| 4,892,217 | 1/1990 | Shastal | 220/269 X |
| 4,936,494 | 6/1990 | Weidman | 215/235 |
| 4,966,294 | 10/1990 | Mack et al. | 220/306 X |

FOREIGN PATENT DOCUMENTS

| | | | |
|---|---|---|---|
| 307196 | 3/1929 | United Kingdom | 215/235 |

OTHER PUBLICATIONS

Brochure, "The Flapper", Weatherchem Corp.

*Primary Examiner*—Stephen marcus
*Assistant Examiner*—Paul A. Schwarz
*Attorney, Agent, or Firm*—Wood, Herron & Evans

[57] ABSTRACT

A snap-on closure for wide mouth containers has an integral hinged lid which can be lifted, as by the thumb, to provide access for spooning contents out of the mouth. The lid closes on a top flange which is presented by either the closure or the container. The closure has a skirt and snaps onto the container below the top flange or to an attachment bead on the container.

13 Claims, 2 Drawing Sheets

CLOSURE FOR A WIDE MOUTH CONTAINER

RELATED INVENTIONS

This application is continuation-in-part of the copending application of Thomas H. Hayes and Lewis C. LoMaglio, titled "Child Resistant, Easy Opening Package," Ser. No. 07/450,039, filed Dec. 13, 1989, now U.S. Pat. No. 5,040,961.

BACKGROUND

This invention relates to container closures, and particularly to a closure for use with a wide mouth container.

So-called "wide mouth" containers are used in the food packaging industry for spreadable or spoonable products such as mayonnaise, mustard, non-dairy creamers, powdered instant coffee, and the like, where it is desirable to be able to insert a spoon, knife, or measure into the mouth of the container to remove the product. Normally such containers have lug or screw type closures which must be turned and removed before product can be removed, and then reseated and turned to close the container again. Once removed, such closures are separate from the containers and can be misplaced.

SUMMARY OF THE INVENTION

It has been a purpose of this invention to provide a closure which can be snapped onto a wide mouth container and which has a hinged lid that can easily be opened, for instance by popping it up with the thumb of one hand, without unscrewing or otherwise removing the entire closure. It has been a further objective of the invention to provide a closure for a wide mouth container having a highly visible tamper evidencing feature which is necessarily ruptured when the closure is first opened.

The closure has a hinged lid which closes and seals the wide mouth of the container. Either the container itself or a part of the closure which snaps onto the container finish presents a top flange against which the lid seats. The closure has a depending annular skirt and snaps onto the container or, where the top flange is presented by the closure, the closure skirt snaps under a bead around the container.

In a preferred embodiment the lid has a snap action hinge which holds the lid stably in an open or up position, as well as in a closed or down position. The lid forms a plug seal with the opening through the top flange. A foil or film disk is secured to the skirt across the top of the lid, or alternatively beneath the lid over the mouth of the container, and must be torn before access can be gained to the mouth of the container.

THE PRIOR ART

Ostrowsky U.S. Pat. No. 4,487,324 shows a closure with a hinged cover which can be snapped onto a narrow neck container such as a catsup bottle. The closure includes a deck which extends across the entire mouth of the container. A sealing post or stud on the lid projects into a discharge orifice in the deck. Tamper evidencing is provided by removable strip which is formed integrally with the closure and is attached by frangible bridges.

Bennett U.S. Pat. Nos. 4,669,622 and 4,700,858 disclose plastic devices having a vertical hollow cylinder for closing the opening necks of containers. Decks seal the upper ends of the cylinders, and caps of essentially the same shape and area as the upper end of the cylinder have snap action lids overlying the deck.

DESCRIPTION OF THE DRAWINGS

The invention can best be further described by reference to the accompanying drawings in which.

DETAILED DESCRIPTION

Figure 1:
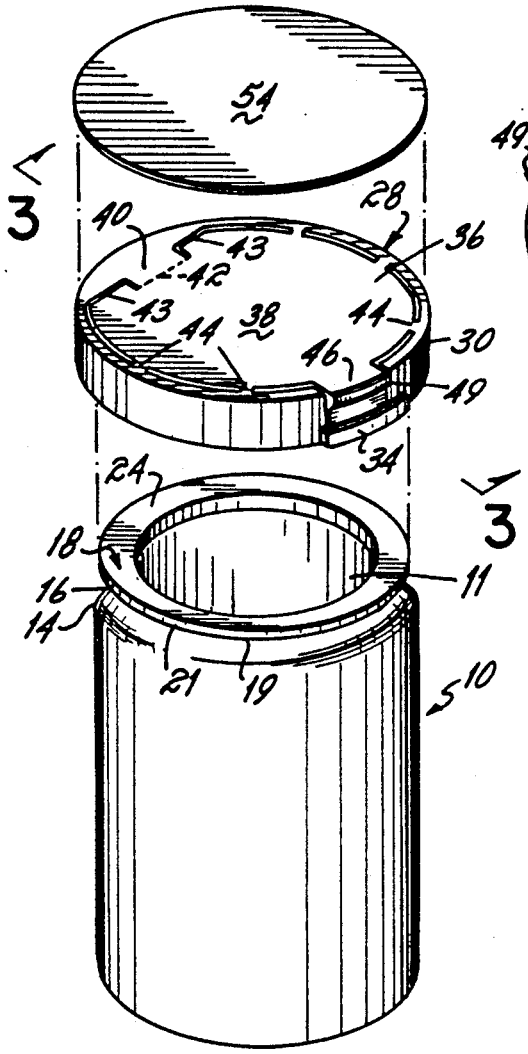
FIG. 1 is an exploded perspective view of a wide mouth container having a closure in accordance with a first embodiment of the invention.

FIG. 1 illustrates a so-called wide mouth container 10 having a top opening or mouth 11 which is wide enough to admit a spoon, blade, or measure, to remove food product from within the container. Typically the mouth 11 of container 10 is at least 2 inches wide. In this embodiment mouth 11 is presented within a neck 16 above a shoulder 14 in the container sidewall. An annular, generally flat or planar top flange 18 extends outwardly from neck 16, around mouth 11. As will be seen, the top surface 24 of flange 18 provides a closure seating area and the undersurface 19 of flange 18 provides a downwardly facing latching surface. The outer or peripheral edge 21 of flange 18 has a diameter less than that of the container side-wall below shoulder 14 (see FIG. 3).

Figure 2:
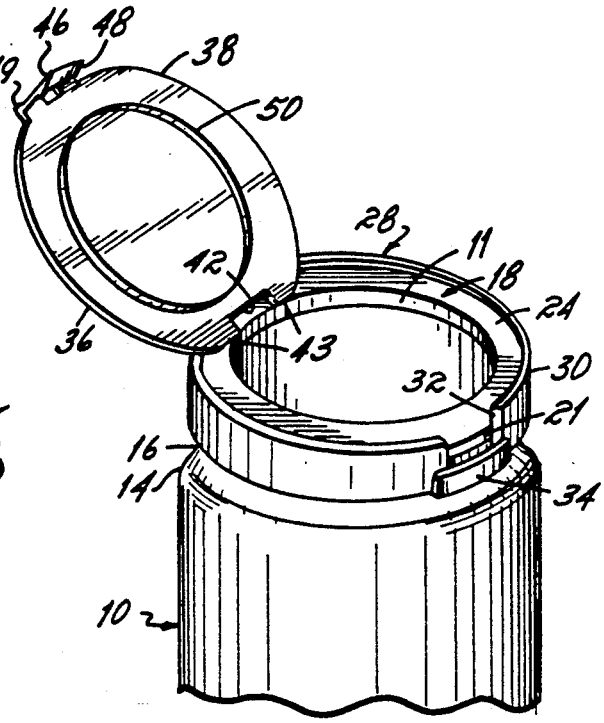
FIG. 2 is a perspective similar to FIG. 1, but shows the closure seated on the container with the lid open.
Figure 3:
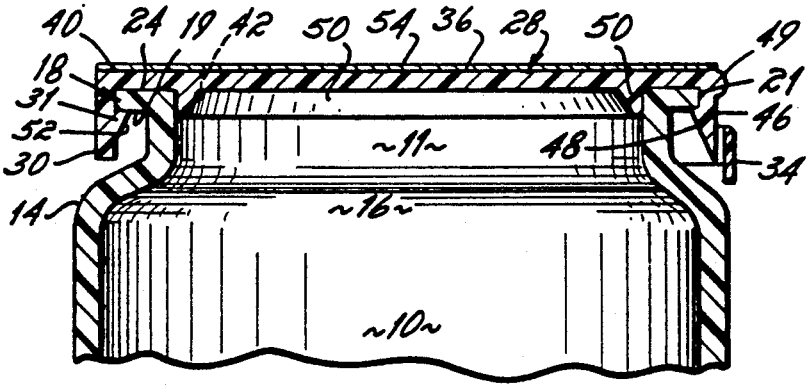
FIG. 3 is an enlarged axial section taken on line 3—3 of FIG. 1.
Figure 6:
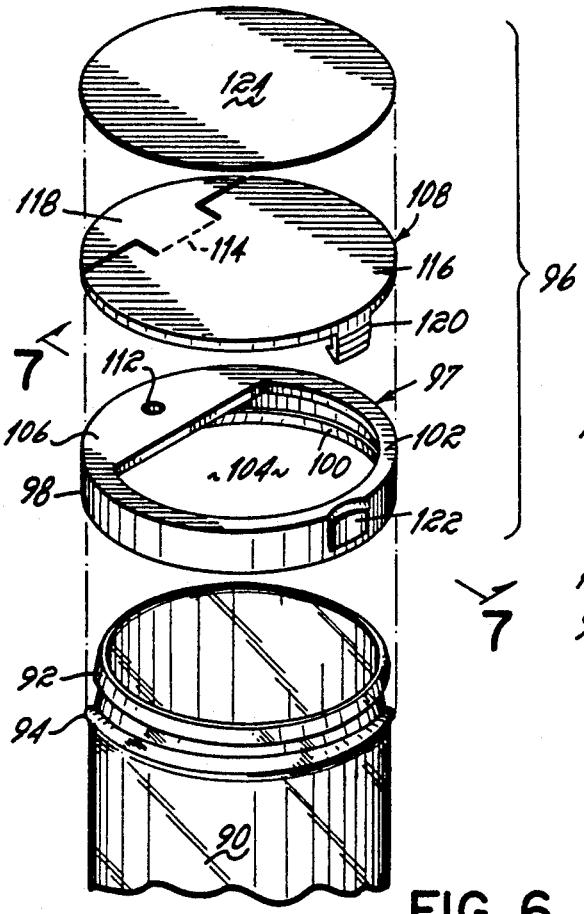
FIG. 6 is an exploded perspective of a closure for a wide mouth container in accordance with a third embodiment of the invention.
Figure 7:
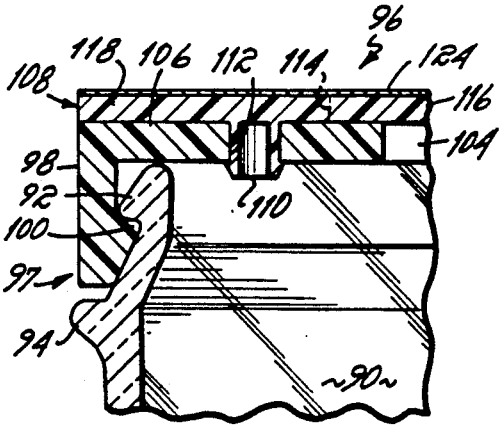
FIG. 7 is an enlarged vertical cross-section taken on line 7—7 of FIG. 6, showing the lid in closed position.

In the first embodiment, shown in FIGS. 1-3, container 10 is preferably of plastic and top flange 18 is formed integrally with it. However, it is contemplated that a top flange can be separately formed and mounted onto a container, as part of the closure. One example of such an embodiment is illustrated in FIGS. 6 and 7 later described herein.

The closure 28 of this first embodiment comprises a short annular skirt 30 which fits snugly around the peripheral rim 21 of flange 18 (see FIG. 3), in line with or inwardly of shoulder 14. Skirt 30 has securing means 31 preferably in the form of one or more detents on its inside surface (FIG. 3) by which it may be snapped under latching surface 19 of the top flange, so as to secure the closure to the container. In this embodiment the securing means 31 extends substantially around the inside periphery of the skirt. On one side skirt 30 is cut away to provide a latch notch 32 (FIG. 2), across which an outwardly spaced strap or bridge 34 extends and connects the skirt across notch 32. Bridge 34 prevents the skirt from being sprung open at notch 32, which would release the closure from the container.

At the top of skirt 30 and within its diameter, closure 28 has a top 36 which includes a swingable lid 38 that is encircled by the upper edge of skirt 30. Lid 38 is hinged to a base portion 40 along a hinge line 42, and is generally circular in outline except at the hinge, preferably having a diameter greater than that of container opening 11 in top flange 18. In its closed position, the periphery of lid 38 overlies and closes opening 11 (see FIG. 3).

Hinge 42 preferably comprises a bi-stable integral or living hinge, for example of the type disclosed in Bennett U.S. Pat. No. 4,700,858, previously referred to, to which reference may be had. The lid hinges about hinge line 42; the hinge 42 bends and lid biasing portions 43, 43, outward of the hinge, bear on the top flange and bias the lid closed until it has been lifted past vertical. After the lid has been lifted past vertical, it is biased toward a stable over-center portion (FIG. 2).

As formed, lid 38 is molded integrally with the closure, being connected around its periphery to the skirt 30 at the top edge of the latter by frangible bridges 44 which rupture when the lid is first lifted. The lid has a downwardly depending or cantilevered spring-like latch 46 which in the down position projects into latching notch 32, inside strap 34 (see FIG. 3). Latch 46 has a catch or detent 48 which is engageable beneath the latching surface 19 of flange 18. The latch is flexible and is biased radially inward toward the latching position shown in FIG. 3. An outwardly projecting rib or tab 49 on the latch can be engaged, as by the thumb, to lift the lid. If desired, lid 38 may have an annular plug seal or bead 50 on its undersurface (see FIGS. 2 and 3) shaped to be received in container opening 11 for better sealing when the lid is closed.

To apply closure 28 to container 10, the closure is seated on container top flange 18 and is pressed downwardly. A tapered cam surface 52 inside detent 31 bends skirt 30 radially outward and the plastic material yields elastically so that the detent 31 can snap into place. Strap 34 prevents opening the skirt in the radial direction sufficiently to remove it; the closure cannot be removed without destruction.

Tamper evidencing is provided by a foil or film disk 54 which is secured on cover top 36, as by adhesive, across the top of lid 38 and the upper edge of the skirt. The foil or film may be perforated to tear when the closure is first opened, around the periphery of lid 38, inward of the skirt, as the bridges 44 are broken. The torn disk makes opening readily apparent. Alternatively, the disk member 54 can be secured to and across the top flange of the container, i.e., below rather than above the cover top. In this case the disk is broken when a spoon or other utensil is first inserted into the mouth of the container. Mounting on top of the closure as shown is preferred in order to show graphics which can be printed on the disk; moreover, in that position the disk provides very visible evidence of opening, and it is not removed as litter.

Figure 4:
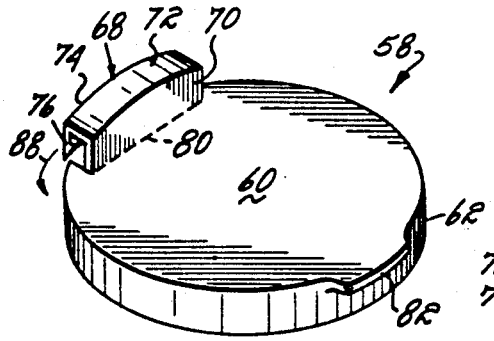
FIG. 4 is a perspective view of a second embodiment of the closure.
Figure 5:
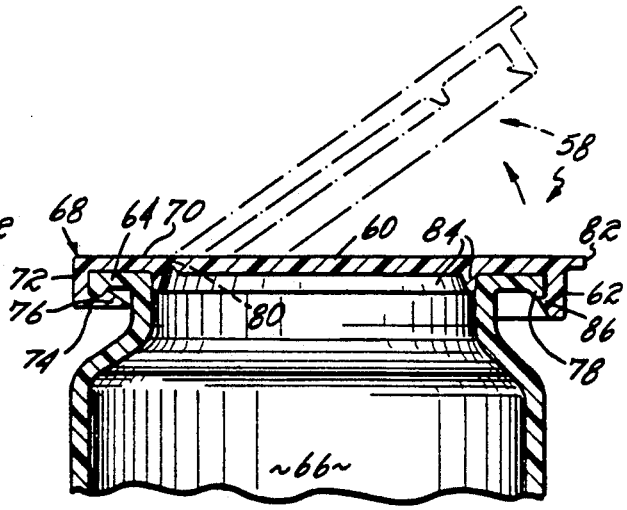
FIG. 5 is an enlarged axial cross-section through a closure of the type shown in FIG. 4, mounted on a container.

In the embodiment shown in FIGS. 1–3, lid 38 is movable with respect to and lifts from an encircling skirt 30. FIGS. 4 and 5 show a modified embodiment wherein the entire closure, including a skirt 62, is lifted, rather than just a separate lid within the skirt. The entire closure 58 of this embodiment clamps onto the container top flange at one side, and the lid and skirt hinge about the clamp. More specifically, closure 58 includes a top or deck 60 having an attached circular depending skirt 62 which is shaped to fit over top flange 64 of the container 66 (FIG. 5). The top 60 and skirt 62 are integrally hinged to container rim securing means or clamp 68. This clamp 68 is generally "C" shaped, as viewed in vertical section in FIG. 5, having a top surface 70 which may be co-extensive with top 60, a vertical back wall portion 72 which may be curved to a diameter corresponding to that of skirt 62, and a bottom wall or snap portion 74 having a snap or detent 76 adapted to engage beneath a peripheral latching rib 78 around the underside of container top flange 64. Clamp top surface 70 joins top 60 along a hinge line 80. Top 60 has a tab 82 by which it can be lifted, and an internal plug seal 84 for closing the mouth of container 66. Adjacent tab 82, skirt 62 has an inwardly projecting latch or detent 86 which catches under rib 78 below the top flange 64. Latch 86 has a cam edge, and/or skirt 62 is sufficiently flexible that the latch will release when tab 82 is lifted.

The cover shown in FIGS. 4 and 5 is applied to a container by seating the skirt on the container top flange and rotating the clamp in the direction of arrow 88, from the raised position shown in FIG. 4 to engage its snap 76 under the rib 78 of the container top flange.

In the two embodiments just described, the top flanges are integral with containers which are formed with sufficient precision to present flat, closely dimensioned flanges. FIGS. 6 and 7 show an alternative embodiment for use where the container is not so precisely formed, for example, where the container is of glass which is difficult to form with a top flange of precise finish dimensions. In this embodiment the container has a less precisely dimensioned latching bead or rib, rather than a top flange, and the closure includes a top flange-presenting component which is snapped onto the latching bead of the container.

More specifically, glass container 90 has an outwardly projecting peripheral latching bead 92, without a top flange. An external peripheral rib 94 is spaced below bead 92 to prevent the closure from being deliberately dislodged. A separately formed, multiple component closure 96 includes a snap-on component 97 with an annular skirt 98 having an inwardly projecting snap detent 100. The detent is engageable beneath bead 92 of the container. Closure component 97 has a chordal flat deck 106 to one side of a central opening or mouth 104 which is in the form of a truncated circle through which access can be had to remove food product from container 90. The snap-on component 97 has an annular top flange 102 which includes deck 106 and extends around opening 104.

Closure 96 also includes a lid piece 108 having a peripheral outline generally corresponding to that of skirt 98. Lid piece 108 has an attachment portion 118 which is facially secured to the deck 106 of closure component 97 as by a snap plug 110 which seats with a snap into an opening 112 in deck 106 (see FIG. 7). Lid piece 108 has an openable lid 116 which is hinged by a self hinge 114 to attachment portion 118. A latch member 120 depends from lid 116 and is engageable in a latch opening 122 in skirt 98 to hold the lid closed. A foil or film seal 124 provides tamper evidencing and is preferably secured across the entire top of lid piece 108 as shown or, less desirably, across top flange 102 or directly to the container 90.

Having described the invention, what is claimed is:

1. A package comprising a wide mouth container and a separate, snap-on closure for the mouth of the container, said container having a planar annular top flange around said mouth, said closure having a hinged lid which seats on said top flange to close said mouth, said lid being openable to provide access to the mouth of said container, said closure having a skirt which extends downwardly around said top flange, said skirt having inwardly facing securing means which snap below said planar top flange to secure said closure to said container, said lid being hinged by an over-center living hinge which holds said lid stably in an open position, said hinge having a hinge line above said top flange and biasing portions outward of said hinge line which bear on said top flange of said container to bias said lid closed until the lid has been moved over center, said lid having an integral, leaf spring-like latch extending downwardly from it which snaps into a latching position.

2. The package of claim 1 wherein said lid has a depending annular rib on its undersurface, said rib forming a plug seal with said mouth.

3. The package of claim 1 wherein said lid when in a closed position is biased toward said top flange and facially engages said top flange.

4. The package of claim 1 further including a tearable disk which blocks access to the mouth of said container unless torn.

5. The package of claim 4 wherein said tearable disk is secured across said lid to said skirt.

6. The package of claim 1 wherein said top flange is integral with said container and extends outwardly around said mouth.

7. The package of claim 1 wherein said skirt has a latch notch into which said latch projects when said lid is closed, a strap connects said skirt across said latch notch, and said latch fits inwardly of said strap.

8. The package of claim 1 wherein said skirt has a top edge which projects above said top flange, and said lid fits within said top edge.

9. The package of claim 8 wherein said lid is connected to said top edge by frangible bridges.

10. The package of claim 9 further including a planar tearable seal which is adhered to said lid and said top edge of said skirt, across said bridges.

11. A package comprising a wide mouth container and a closure for the mouth of the container, said container having an integral annular top flange which extends outwardly around said mouth, said closure having a top which covers the mouth of said container, the major portion of the area of said top comprising an openable lid which is hinged along a line adjacent the perimeter of said top to a minor portion of the area of said top, a clamp depending from said minor portion and having means gripping a minor arcuate portion of said flange to secure said closure to said container, said clamp being C-shaped in vertical section with top and bottom surfaces which grip said flange between them, said clamp being engageable with said flange to secure said closure to said container by moving said clamp laterally in the plane of said flange, and a skirt depending from the perimeter of said lid below said flange, said skirt having snap means engageable with said flange to hold said lid closed.

12. The package of claim 11 wherein said lid includes a portion on each side of said hinge which bears on said top flange when said lid is open, to provide a spring bias on said lid.

13. The package of claim 11 wherein said clamp has a bottom leg with a detent which snaps under said top flange.

* * * * *